US005626636A

United States Patent [19]

Carter

[11] Patent Number: 5,626,636

[45] Date of Patent: May 6, 1997

[54] COMBUSTIBLE BAG FOR IGNITING MATERIAL CONTAINED THEREIN APPARATUS AND METHOD

[76] Inventor: Freddy E. Carter, P.O. Box 1644, Brownwood, Tex. 76804

[21] Appl. No.: 527,710

[22] Filed: Sep. 13, 1995

[51] Int. Cl.[6] ..... C10L 5/00

[52] U.S. Cl. ..... 44/533; 44/541; 44/544

[58] Field of Search ..... 44/532, 533, 534, 44/541, 542, 544, 572, 590

[56] References Cited

U.S. PATENT DOCUMENTS

| | | | |
|---|---|---|---|
| 135,607 | 2/1873 | Tucker | 44/542 |
| 252,420 | 1/1882 | Blaisdell | 44/534 |
| 390,610 | 10/1888 | MacBrair | 44/541 |
| 2,799,563 | 7/1957 | Shenker | 44/541 |
| 3,351,443 | 11/1967 | Gramm et al. | 44/541 |
| 3,635,684 | 1/1972 | Seymour . | |
| 4,040,796 | 8/1977 | Vincent et al. | 44/541 |
| 4,101,292 | 7/1978 | Hogan | 44/534 |
| 4,104,034 | 8/1978 | Wu et al. | 44/534 |
| 4,179,270 | 12/1979 | Clayton et al. . | |
| 4,386,937 | 6/1983 | Fareri et al. . | |
| 4,518,394 | 5/1985 | Templin et al. . | |
| 4,725,286 | 2/1988 | Brame . | |
| 5,456,732 | 10/1995 | Baxter | 44/534 |

*Primary Examiner*—Jacqueline V. Howard
*Assistant Examiner*—Cephia D. Toomer
*Attorney, Agent, or Firm*—J. Nevin Shaffer, Jr.; Shaffer & Culbertson

[57] ABSTRACT

A combustible bag for igniting material (10) having an outer liner (12) and an inner liner (14). A lighting strip (16) is attached to one or both ends of the outer liner (12) and extends beyond the bag for ease of ignition. The inner liner (14) consists of an inside (24) and an outside (26), with the inside (24) conformed to contain material (22) to be ignited, such as wood chunks, and an outside (26) which is treated with a combustible product (28). The outer liner (12) also has an inside (30) and an outside (32). The inside (30) of the outer liner (12) is conformed to contain the inner liner (14) and is also treated with a combustible product (28). The material to be ignited by the combustible bag (10) of the present invention, in a preferred embodiment, includes dried green wood, which has been treated with paraffin so that the paraffin not only covers the wood, but impregnates it, as well.

4 Claims, 1 Drawing Sheet

COMBUSTIBLE BAG FOR IGNITING MATERIAL CONTAINED THEREIN APPARATUS AND METHOD

BACKGROUND OF THE INVENTION

This invention relates to an improved combustible bag for igniting material contained therein.

A variety of combustible bags have been known in the art for quite some time. The primary example and major utilization is with combustible bags of charcoal. These bags are utilized all over the world for outdoor barbecues, at picnics, and the like. However, several concerns have developed regarding the use of these bags.

To begin with, the charcoal in these bags is made combustible by means of the utilization of some chemical, such as lighter fluid. While the purpose of the lighter fluid is to insure that the bag and the charcoal light, the lighter fluid also poses a potential fire hazard, in that, during the time the charcoal is stored it could have a tendency to spontaneously combust. Additionally, to a greater or lessor extent, the lighter fluid itself imparts a petroleum taste to the foods being grilled and, also, the charcoal and bags known in the prior art leave a large amount of ash, which is not environmentally friendly.

Thus, there is a need in the art for a combustible bag which does not use lighter fluid and, therefore, is not likely to be prone to spontaneous combustion; which is capable of safely containing the material to be ignited without allowing it to poke through the bag; which is environmentally friendly and leaves only a small amount of ash that can be used in flower beds and the like; and a combustible bag which can be conveniently used without leaving an unpleasant flavor in the foods being grilled. It, therefore, is an object of the present invention to provide an improved combustible bag, which is capable of conveniently igniting materials enclosed therein without the necessity of utilizing petroleum products, i.e. lighter fluid; which is environmentally friendly and which does not impart an artificial petroleum flavor to the grilled products.

SHORT STATEMENT OF THE INVENTION

Accordingly, the combustible bag for igniting material contained therein of the present invention includes an inner liner for containing and enveloping a material to be ignited and an outer liner for igniting the inner liner, which is conformed and joined to the inner liner. A lighting strip attached to the outside of the outer liner is utilized for igniting the outer liner. The lighting strip, in a preferred embodiment, is attached transversely to a longitudinal dimension of the bag at at least one end of the bag so that the free ends of the lighting strip extend beyond the outer liner and are available for easy lighting.

More particularly, the combustible bag of the present invention includes an inner liner where the inner liner has an inside and an outside, and the inside is conformed to contain the material to be ignited. The outside of the inner liner is treated with a combustible product so that when the combustible product is ignited, the inner liner ignites and, in turn, so is the contained material. Likewise, the outer liner includes a liner with an inside and an outside and the inside of the outer liner is conformed to contain the inner liner. The outer liner, however, has the inside treated with a combustible product so that when the inside of the outer liner is ignited, in turn, the outside of the inner liner is ignited.

Additionally, the material which is ignited in a preferred embodiment includes a green wood which has been dried so that insects and moisture are removed and pores in the green wood are created. After which, a combustible product, such as paraffin, is applied to the dried green wood so that the paraffin fills the pores and coats the outside of the dried green wood.

BRIEF DESCRIPTION OF THE DRAWINGS

Other objects, advantages, and features of the present invention will become more fully apparent from the following detailed description of the preferred embodiment, the appended claims and the accompanying drawings in which:

DETAILED DESCRIPTION OF THE PREFERRED EMBODIMENT

Figure 1:
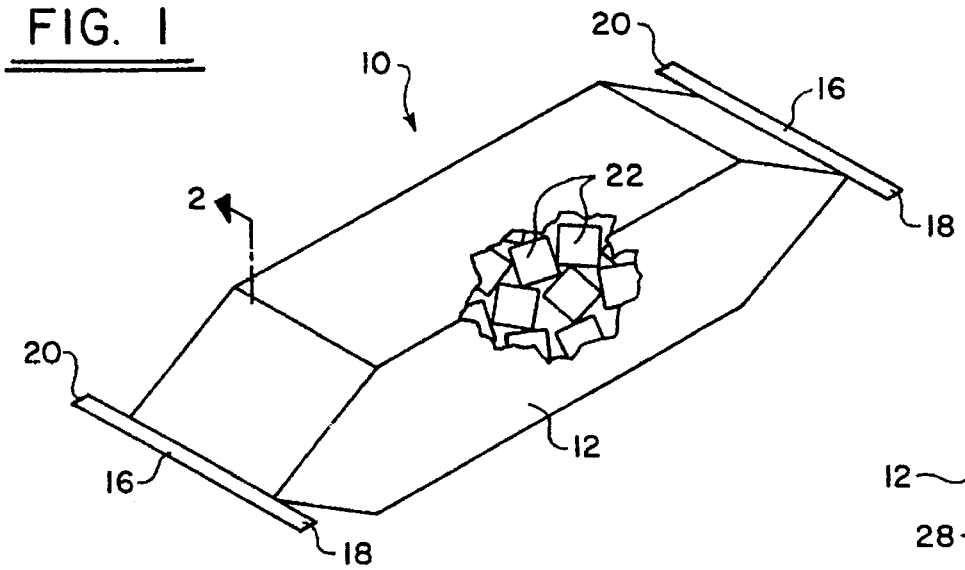
FIG. 1 is a plan view of the preferred embodiment of the combustible bag for igniting material contained therein of the present invention, with the bag being partially broken away to reveal the material therein.
Figure 2:
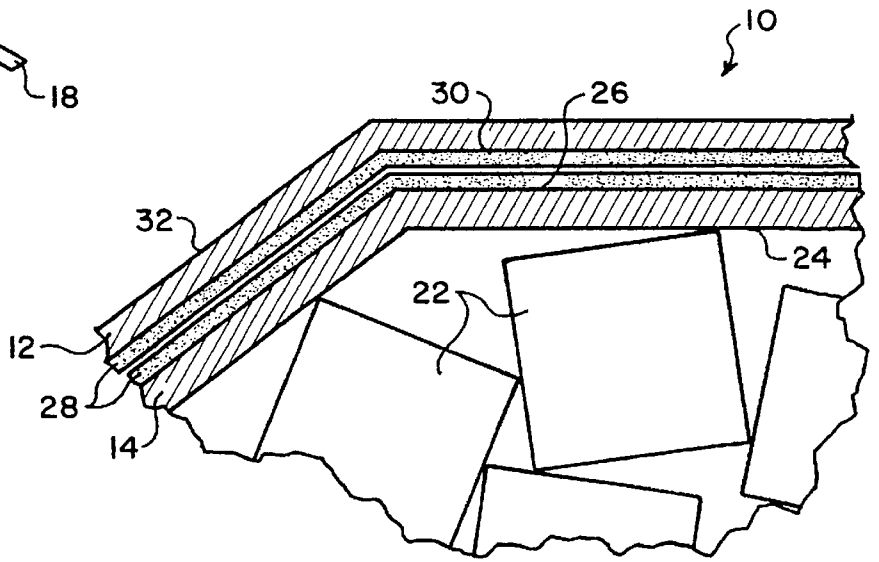
FIG. 2 is a side section view showing the various layers of the inner and outer bag.
Figure 3:
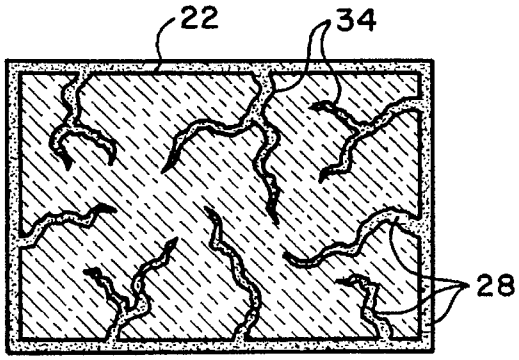
FIG. 3 is a side section view of a piece of dried green wood covered and impregnated with paraffin.

The preferred embodiment of the present invention is illustrated by way of example in FIGS. 1–3. With specific reference to FIGS. 1 and 2, a combustible bag for igniting material 10 includes an outer liner 12 and an inner liner 14 (see FIG. 2). A lighting strip 16 is attached transversely to a longitudinal end of bag 10 and, in a preferred embodiment, to both ends, as shown in FIG. 1. The lighting strip 16 is attached so that free ends 18 and 20 extend beyond the outer liner 12 for ease of ignition. Material 22 is enclosed in inner liner 14 and will be more fully described hereafter. Specifically, inner liner 14 includes an inside 24 conformed to contained material 22 and an outside 26 which is treated with a combustible product 28, such as polyethylene.

Likewise, outer liner 12 includes an inside 30 and an outside 32. The inside 30 of outer liner 12 is conformed to contain inner liner 14. In one embodiment, inner liner 14 is secured to outer liner 12 by any means known in the art, i.e. staples, glue, and the like. Additionally, the inside 30 of outer liner 12 is also treated with a combustible product 28 so that, once outer liner 12 is successfully ignited, it is insured that inner liner 14 will also be ignited and, subsequently, material 22.

Referring now to FIG. 3, a cross section of material 22 is shown. In line with the object of the invention, material 22, while it could be charcoal impregnated with lighter fluid, is not in a preferred embodiment. In a preferred embodiment, material 22 is green wood which has been dried so that insects and moisture are driven off and so that pores 34 in the wood are created and exposed. Subsequent to the drying of the green wood, a combustible product 28 is applied to the dried green wood. In a preferred embodiment, the combustible product 28 is USDA approved paraffin. Again, once dried, the paraffin not only covers the outside of the dried green wood, but penetrates and impregnates the dried green wood pores with paraffin.

Accordingly, a combustible bag for igniting material 10 comprises an outer liner 12 and an inner liner 14. Inner liner 14 is conformed so as to completely contain within an enclosed relationship a plurality of material 22. In a preferred embodiment, material 22 is comprised of a number of pieces of dried green wood that have been treated with paraffin so that paraffin covers not only the exterior but the interior of wood material 22. Inner liner 14 includes an inside 24 and outside 26, and the outside 26 is treated with a combustible product 28. Substantially directly adjacent to the inner liner 14 is the inside 30 of the outer liner 12. The inside 30 of outer liner 12 is also treated with combustible product 28. Outer liner 12 is conformed to receive inner liner 14 and may be held in close, non-moving relationship by means of staples, glue and the like (not shown).

Further, lighting strip 16, is applied to each end of out liner 12 and has free ends 18 and 20 of lighting strip 16, which extend beyond the combustible bag for igniting material 10 for ease of igniting.

In use, a filled bag is placed in a grill or other suitable barbecuing facility (not shown). The lighting strip 16 is lighted at the free ends 18 and 20. This results in the ignition of outer liner 12. The ignition of outer liner 12 ultimately results in the ignition of inside 30 of outer liner 12 which has been treated with combustible product 28. Combustible product 28 then ignites the outside 26 of inner liner 14. Ultimately, with the ignition of both the outer liner 12 and inner liner 14 assured, a sustained ignition process is created so that enough heat is continuously applied to insure the ignition of material 22 contained within inner liner 14. That is, in a preferred embodiment, inner liner 14 inside 24 is constructed of 50 lb. natural Kraft brand paper. Outside 26 of inner liner 14 is constructed of a combustible material 28 such as 1.0 mil. high density polyethylene. The inside 30 of outer liner 12 is also treated with a combustible material 28 such as a 15 lb. low density polyethylene on a 40 lb. natural Kraft brand paper outside 32. It has been found that this embodiment does not burn too quickly, up to 20 minutes, but is hot enough to ignite material 22 and does not leave a lot of ash or create distasteful fumes.

Inner liner 14 is designed specifically to contain the hard rough pieces of material 22 and to prevent them from protruding beyond inner liner 14. Outer liner 12 is specifically designed so as to prevent either the additional escape of material 22 and/or the bleeding of combustible product 28 from the material or the insides of combustible bag for igniting material 10. This is a common problem found in prior art charcoal bags. Additionally, lighting strip 16 may also include some combustible product 28 in order to insure the ease of ignition, as well.

While the present invention has been disclosed with preferred embodiment thereof, it should be understood that there may be other embodiments which fall within the spirit and scope of the invention as defined by the following claims.

I claim:

1. A combustible double bag for igniting pre-treated material contained therein comprising:

a) an inner liner with an inside and an outside, the inside conformed to contain the material to be ignited;

b) the outside of the inner liner covered with a separate combustible product so that when the separate combustible product is ignited, the inner liner is ignited and, in turn, so is the pre-treated material;

c) an outer liner with an inside and an outside, the outside conformed to contain the inner liner;

d) the inside of the outer liner covered with a separate combustible product so that when the outer liner is ignited, the inside of the outer liner is ignited and, in turn, the separate combustible product covering the outside of the inner liner is ignited; and e) a lighting strip for igniting the outside of the outer liner, which is attached to the outer liner so that igniting the lighting strip ignites the outside of the outer liner.

2. The combustible double bag of claim 1 further comprising a lighting strip means attached transversely to a longitudinal dimension of the bag at at least one end of the bag so that free ends of the lighting strip extend beyond the outer liner for ease of ignition.

3. The combustible double bag of claim 2 wherein the material to be ignited further comprises:

a) green wood dried so that insects and moisture are removed and pores in the green wood are created; and b) paraffin applied to the green wood after it is dried so that the paraffin fills the pores and coats the outside of the green wood.

4. A method of igniting pre-treated material comprising the steps of:

a) drying green wood to remove insects and moisture and to expose the pores for treatment;

b) applying paraffin to the green wood after it is dried so that paraffin fills the pores and coats the outside of the green wood;

c) containing the green wood with paraffin within an inner liner with an outside and an inside conformed to contain the wood;

d) covering the outside of the inner liner with a separate combustible product;

e) attaching an outer liner, with an inside and an outside, to the inner liner;

f) covering the inside of the outside liner with a separate combustible product;

g) attaching a lighting strip to the outside of the outer liner; and h) igniting the lighting strip so that the outer liner ignites the separate combustible product covering the inside of the outside liner, which in turn ignites the separate combustible product covering the outside of the inner liner, which then ignites the inner liner as the inner liner ignites the pretreated material.

* * * * *